US009683822B2

(12) United States Patent
Kerns et al.

(10) Patent No.: US 9,683,822 B2
(45) Date of Patent: Jun. 20, 2017

(54) MUNITION WITH PREFORMED FRAGMENTS

(71) Applicant: Raytheon Company, Waltham, MA (US)

(72) Inventors: Keith A Kerns, Tuscon, AZ (US); John J. Spilotro, Tuscon, AZ (US); Thomas H. Bootes, Tuscon, AZ (US); Brandon J. Cundiff, Oro Valley, AZ (US); Jesse T. Waddell, Tucson, AZ (US); Wayne Y. Lee, Vail, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 14/723,804

(22) Filed: May 28, 2015

(65) Prior Publication Data

US 2016/0349027 A1 Dec. 1, 2016

(51) Int. Cl.
*F42B 12/32* (2006.01)
*F42B 12/34* (2006.01)
(Continued)

(52) U.S. Cl.
CPC ..... *F42B 12/34* (2013.01); *F42B 12/32* (2013.01); *F42B 12/58* (2013.01); *F42B 33/001* (2013.01)

(58) Field of Classification Search
CPC ..... F42B 12/32
(Continued)

(56) References Cited

U.S. PATENT DOCUMENTS 3,882,779 A * 5/1975 Frostig ..... F42B 12/32 102/372
4,592,283 A 6/1986 Hellner et al.
(Continued)

FOREIGN PATENT DOCUMENTS

WO 2008073540 A2 6/2008

OTHER PUBLICATIONS

International Search Report and Written Opinion from corresponding International Application No. PCT/US2015/066242, mailed on Apr. 5, 2016.

*Primary Examiner* — Reginald Tillman, Jr.
(74) *Attorney, Agent, or Firm* — Renner, Otto, Boisselle & Sklar, LLP

(57) ABSTRACT

A munition that is adapted to enhance fragmentation effects upon detonation includes preformed fragments between a casing and a shell. The overall mass of the preformed fragments is greater than the overall combined mass of the casing and the shell for enhancing the degree of controlled fragmentation compared to uncontrolled fragmentation. By enhancing the dispersal of controlled fragmentation, the overall fragmentation area coverage and fragmentation pattern density may also be enhanced while limiting travel of the fragmentation beyond the target area for reducing collateral damage. The preformed fragments may fill a continuous volume between the casing and the shell to effectively utilize the munition volume and to maximize the amount of preformed fragments contained within the shell. The preformed fragments may be free flowing pellets that are poured into the volume between the casing and the shell for enhancing distribution of the fragments and for improving assembly of the munition.

16 Claims, 10 Drawing Sheets

(51) Int. Cl.
*F42B 33/00* (2006.01)
*F42B 12/58* (2006.01)

(58) Field of Classification Search
USPC ..... 102/492, 494
See application file for complete search history.

(56) References Cited

U.S. PATENT DOCUMENTS

| | | | | |
|---|---|---|---|---|
| 4,648,323 | A | 3/1987 | Lawther | |
| 5,117,759 | A | 6/1992 | Henderson et al. | |
| 6,374,744 | B1 | 4/2002 | Schmacker et al. | |
| 6,484,642 | B1 | 11/2002 | Kuhns et al. | |
| 6,619,210 | B1 | 9/2003 | Spivak et al. | |
| 7,614,348 | B2 | 11/2009 | Truitt et al. | |
| 8,061,275 | B1 | 11/2011 | Gold | |
| 8,671,840 | B2 | 3/2014 | Scheid et al. | |
| 9,291,437 | B2 * | 3/2016 | Bonnstetter | F42B 12/24 |
| 2003/0172833 | A1 * | 9/2003 | Ronn | F42B 12/22 102/489 |
| 2006/0112847 | A1 | 6/2006 | Lloyd | |
| 2014/0299012 | A1 * | 10/2014 | Odintsov | F42B 12/32 102/491 |
| 2016/0025467 | A1 * | 1/2016 | Botthof | F42B 12/22 102/492 |

* cited by examiner

MUNITION WITH PREFORMED FRAGMENTS

FIELD OF INVENTION

The present invention relates generally to munitions, and more particularly to area weapons having preformed fragments.

BACKGROUND

Area weapons having height-of-burst (HOB) capabilities for open targets generally use steel casings and heavy airframes that contribute to much of the overall mass of the weapon. These relatively heavy solid-wall structures produce an increased amount of uncontrolled fragmentation upon detonation of the weapon. The dispersal of uncontrolled fragmentation typically results in unwanted travel of the fragments beyond the target area, which leads to collateral damage.

SUMMARY

The present invention provides a munition, such as a bomb or missile, that is adapted to enhance overall fragmentation area coverage and fragmentation pattern density while limiting travel of the fragmentation beyond the target area of the munition. The munition includes preformed fragments between a casing and a shell, in which the overall mass of the preformed fragments is greater than an overall combined mass of the casing and the shell. Such a munition configuration is effective in providing a greater degree of controlled fragmentation compared to uncontrolled fragmentation, which enables the munition to be used as an area weapon having height-of-burst capabilities that minimizes collateral damage outside of the target area. The preformed fragments may fill a continuous volume between the casing and the shell for maximizing the amount of preformed fragments and for effectively distributing the preformed fragments within the shell, while also improving ease of assembly of the munition.

According to an aspect of the invention, a munition includes a casing, an explosive enclosed by the casing, a shell surrounding the casing, and preformed fragments in a volume between the casing and the shell, wherein the preformed fragments have a combined mass greater than the combined mass of the casing and the shell for enhancing the amount of controlled fragmentation compared to uncontrolled fragmentation.

Embodiments of the invention may include one or more of the following additional features. For example, the preformed fragments may fill the volume between the casing and the shell to continuously surround the radially outer surface of the casing from one end of the casing to the opposite end of the casing for maximizing the amount of preformed fragments.

In some embodiments, the ratio of the combined mass of preformed fragments to the combined mass of the casing and the shell may be at least 1.05:1, more particularly between 1.2:1 to 3:1, and even more particularly between 1.5:1 to 2:1, for maximizing the ratio of controlled fragments to uncontrolled fragments while emulating the overall weight, weight distribution, and aerodynamic properties of an existing munition. This may facilitate improved compatibility of the munition with an existing guidance system.

In some embodiments, the preformed fragments may include balls having a diameter between 0.10 inches to 0.50 inches. In other embodiments, the preformed fragments may include balls having a diameter between 0.175 and 0.375 inches.

The preformed fragments may include balls having a first size distribution between 0.10 inches to 0.25 inches in diameter, and a second size distribution between 0.25 inches to 0.50 inches in diameter, wherein a ratio of the amount of preformed fragments having the first size distribution to the amount of preformed fragments having the second size distribution is between 1:1 to 20:1, more particularly about 4:1, for improved fragmentation area coverage and fragmentation pattern density.

The preformed fragments may be in the form of spheroidal balls.

The preformed fragments may include fragments having flat bodies, such as star-shaped fragments having a series of protrusions extending from each of the flat bodies.

The preformed fragments may include flechettes, or other pointed projectiles.

In some embodiments, the preformed fragments may include free flowing metal pellets.

The free flowing metal pellets may be poured into the volume between the casing and the shell for enhancing distribution of the fragments and for improving assembly of the munition.

In some embodiments, the preformed fragments may be disposed in the volume between the casing and the shell to emulate the mass and/or center of gravity characteristics of an existing munition for improving compatibility with existing guidance systems.

In some embodiments, the preformed fragments may be enclosed as parts of self-contained fragmentation packs.

The fragmentation packs may be located in the volume between the casing and the shell.

Optionally or additionally, the fragmentation packs may be flexible.

The fragmentation packs may include a casing that contains the preformed fragments, wherein the casing is made of a metal and/or plastic.

In some embodiments, the preformed fragments may be cast fragment blocks that include multiple of the preformed fragments held together by a binder.

The cast fragment blocks may be adhesively and/or mechanically secured to the shell.

In some embodiments, some or all of the preformed fragments are made of metal, such as steel, zirconium-coated steel, tungsten, zirconium-coated tungsten, aluminum, tantalum, lead, titanium, zirconium, copper, molybdenum, magnesium, or other suitable materials.

The preformed fragments may include one or more types of fragments. For example, the preformed fragments may include fragments with different materials, different shapes, and/or different sizes. Alternatively, all of the fragments may be substantially identical in material, size, and shape.

The preformed fragments may be spheroidal fragments, such as reactive material coated metal alloy balls.

In some embodiments, the volume between the casing and the shell includes fragment-free interstices between adjacent preformed fragments.

Optionally or additionally, the fragment-free interstices may be filled with a filler material.

The filler material may include a polymeric material. For example, the filler may be polypropylene spheres, or other low-density filler material.

The filler material may include a metallic powder, such as reactive metals and/or pyrophoric metals. For example, the metallic powder may be aluminum, magnesium, zirconium or titanium metal powder.

The filler material may be sized to fill the interstitial spaces between the preformed fragments.

The filler material may include incendiary materials.

In some embodiments, the shell is configured as an airframe.

The airframe may have a clamshell configuration.

The airframe may be configured to emulate the aerodynamic properties of an existing munition's airframe.

The airframe may be configured to mount with a nose kit and/or a tail kit configured for mounting to an existing munition.

Optionally or additionally, the mass of the airframe may be minimized for reducing the amount of uncontrolled fragmentation upon detonation of the munition. For example, the mass of the airframe may be reduced by minimizing the wall thickness of the shell.

The shell may be made of aluminum, titanium, composites, or other lightweight materials.

In some embodiments, the casing is a unitary welded casing made of steel, or other suitable hard material.

According to another aspect of the invention, a munition includes a casing, an explosive within the casing, a shell radially outwardly spaced from the casing that forms an annular volume that is continuous from one end of the casing to an opposite end of the casing, and preformed fragments that fill the annular volume and continuously surround the radially outer surface of the casing from the one end of the casing to the opposite end of the casing for maximizing the amount of preformed fragments and enhancing the degree of controlled fragmentation.

In some embodiments, the preformed fragments are randomly distributed within the annular volume.

In some embodiments, the preformed fragments include preformed fragments having different size distributions, different material compositions, and/or different densities.

In some embodiments, the preformed fragments may include categories of preformed fragments having different sizes, different size distributions, different shapes, different material compositions, and/or different densities, and the respective categories of preformed fragments may be arranged in layers in the annular volume.

The respective categories of preformed fragments may be layered in the annular volume as annular rings surrounding the radially outer surface of the casing.

In some embodiments, the preformed fragments are admixed with filler material to enhance packing density within the annular volume.

The filler material may be sized smaller than the interstitial spaces between the preformed fragments.

According to yet another aspect of the invention, a method for assembling a munition includes the steps: (i) encasing an explosive in a canister, (ii) enclosing the canister within a shell housing, and (iii) after the enclosing, pouring preformed fragmentation into a volume between the canister and the shell housing.

Optionally or additionally, the method may further include the steps: (i) filling the volume between the canister and the shell housing with the preformed fragments and surrounding the radially outer surface of the canister with the preformed fragments from one end of the canister to the opposite end of the canister, and (ii) sealing the volume between the canister and the shell housing.

Optionally or additionally, the method may further include the steps: (i) filling the volume between the canister and the shell housing with the preformed fragments and determining a fragmentation fill volume, (ii) calculating a void volume, which is the difference between the fragmentation fill volume and the volume between the canister and the shell housing, (iii) emptying the preformed fragments, (iv) admixing a filler material, such as a low-density filler material, with the preformed fragments, wherein the volume of filler material is about equal to or less than the calculated void volume, and (v) after the admixing, pouring the admixture of preformed fragments and filler material into the volume between the canister and the shell housing.

To the accomplishment of the foregoing and related ends, the invention comprises the features hereinafter fully described and particularly pointed out in the claims. The following description and the annexed drawings set forth certain illustrative embodiments of the invention. These embodiments are indicative, however, of but a few of the various ways in which the principles of the invention may be employed. Other objects, advantages and novel features according to aspects of the invention will become apparent from the following detailed description when considered in conjunction with the drawings.

BRIEF DESCRIPTION OF THE DRAWINGS

The annexed drawings, which are not necessarily to scale, show various aspects of the invention.

DETAILED DESCRIPTION

A munition that is adapted to enhance fragmentation effects upon detonation includes preformed fragments between a casing and a shell. The overall mass of the preformed fragments is greater than the overall combined mass of the casing and the shell for enhancing the degree of controlled fragmentation compared to uncontrolled fragmentation. By enhancing the dispersal of controlled fragmentation, the overall fragmentation area coverage and fragmentation pattern density may also be enhanced while limiting travel of the fragmentation beyond the target area for reducing collateral damage. The preformed fragments may fill a continuous volume between the casing and the shell to effectively utilize the munition volume and to maximize the amount of preformed fragments contained within the shell. The preformed fragments may be free flowing pellets that are poured into the volume between the casing and the shell for enhancing distribution of the fragments and for improving assembly of the munition.

Figure 1:
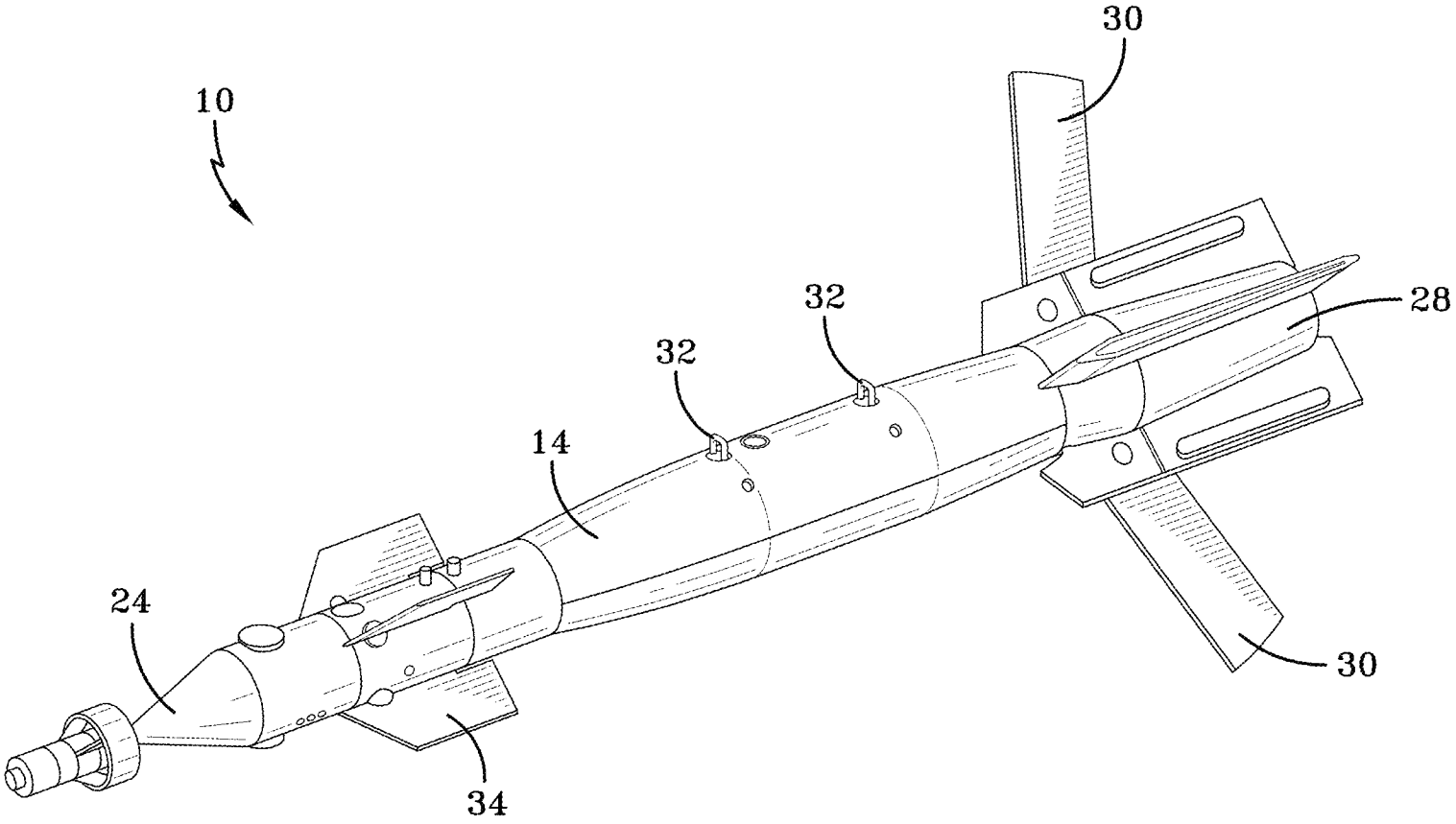
FIG. 1 is a perspective view of a munition in accordance with an embodiment of the invention.
Figure 2:
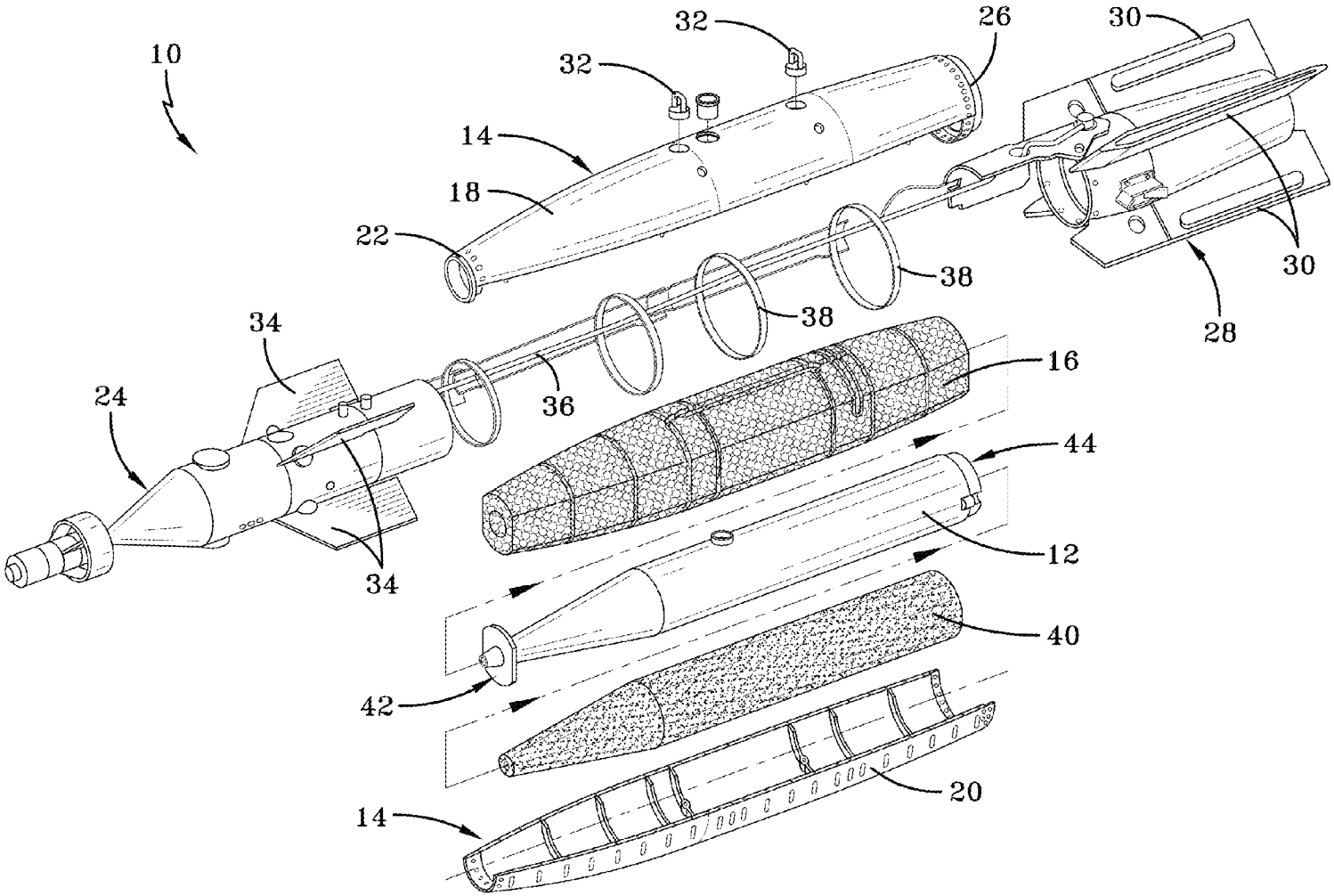
FIG. 2 is an exploded view of the munition of FIG. 1.
Figure 3:
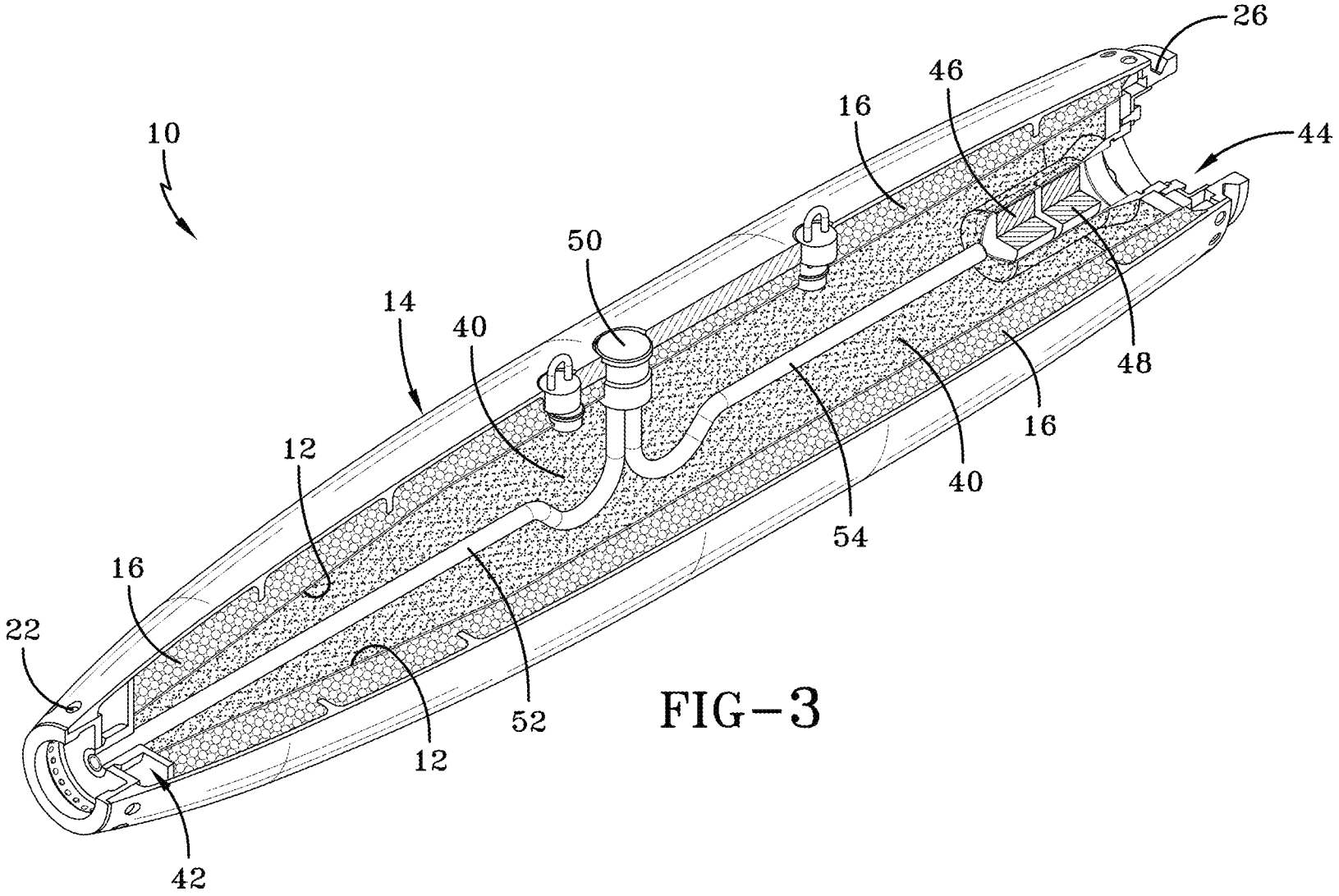
FIG. 3 is a perspective partial cutaway view of part of the munition of FIG. 1.

Turning to FIGS. 1-3, an exemplary munition 10 is shown having a casing 12, a shell 14, and preformed fragments 16 located between the casing 12 and the shell 14. The shell 14 may be in the form of a pair of clamshell halves 18 and 20 that enclose the casing 12. The shell 14 is radially outwardly spaced from the casing 12 to define an annular volume for receiving and containing the preformed fragments 16. Other materials, such as fillers or lethality-enhancement materials may also be disposed in the volume between the casing 12 and the shell 14, as discussed in further detail below.

The shell 14 may be configured as an airframe having a size, weight, center of gravity and/or aerodynamic profile for enabling flight of the munition 10. The shell 14, also referred to herein as the airframe 14, may be configured to correspond to the size, shape, weight, weight distribution, and/or profile of another type of munition, such as the airframe of an existing munition. More particularly, the airframe 14 may be configured to emulate the aerodynamic properties of an existing munition airframe, including the integration of certain components into the airframe 14, for enabling the munition 10 to be compatible with existing guidance enhancement capabilities. For example, by emulating the size, weight, center of gravity, etc. of an existing munition, a laser guidance provided as part of a PAVEWAY system, produced by Raytheon Company, may be easily adapted to the munition 10.

So as to minimize the amount of uncontrolled fragmentation caused by fragmenting the airframe 14 upon detonation, the mass of the airframe 14 may be minimized. For example, the airframe 14 may be made of relatively lightweight materials, such as aluminum, titanium, or composite materials, for example, fiber-reinforced composites or metal matrix composites. The wall thickness of the airframe 14 may also be reduced for minimizing uncontrolled fragmentation, which may increase the size of the annular volume and enable an increase in the amount of preformed fragments 16 (controlled fragmentation) disposed in the volume. As will be discussed in further detail below, the mass and/or quantity of the preformed fragments 16 may be distributed within the volume to compensate for the reduced mass of the airframe 14 so as to maintain the desired weight and weight distribution of the munition 10 for enabling flight and/or guidance system compatibility.

The illustrated embodiment shows an exemplary configuration for the airframe 14. A wide variety of variations are possible, and the specific features of the illustrated embodiment (the clamshell halves 18 and 20, for example) should not be considered as necessary essential features. In the illustrated embodiment, the airframe 14 includes a forward connection 22 (e.g., bulkhead fitting) for receiving a guidance nose kit 24 (for example), and an aft connection 26 (e.g., tail ring) for receiving a tail kit 28 (for example). The airframe 14 may include connection lugs 32 configured to be coupled to an aircraft or mounted on a launch platform that is also able to receive other types of weapons. The forward connection 22 and aft connection 26 may be standard connections that are similar to those used for other munitions, thus enabling use of a standard nose kit and tail kit that may be used with other sorts of munitions. The nose kit 24 and the tail kit 28 may also be parts of a standard enhancement for providing laser guidance capability for unguided munitions, such as PAVEWAY modified munitions. The nose kit 24 and the tail kit 28 may be made of lightweight components, such as aluminum, titanium, or composites. Other types of nose kits and/or tail kits may be used in place of those in the illustrated embodiment.

The guidance nose kit 24 may have canards 34 that are selectively moved to guide the munition 10 toward a desired target location. The nose kit 24 may include wiring 36 that is used to make communication with a launch platform to provide information on the target location and/or other parameters for operation of the munition 10. The electrical connection with the launch platform may also be used to provide electrical power to the munition 10 prior to launch. Batteries on the munition 10 (not shown) may provide power after separation form the aircraft or other launcher. A series of straps or hoops 38 may be used to hold the wiring 36 in place. The tail kit 38 includes fins 30, which may be deployable to provide in-flight stability to the enhanced munition 10.

Referring to FIGS. 2-3, the casing 12 encloses an explosive 40, which may be any variety of known explosive materials. For example, the explosive may be PBXN-110, a plastic-bonded high-explosive. The casing 12 may be made out of a suitable metal, such as a suitable steel (for example 4340 steel), or another hard material, such as titanium or tungsten. The casing 12 may be a unitary welded casing (or canister) 12 in which the explosive 40 is cast. So as to minimize the degree of uncontrolled fragmentation caused by fragmenting the casing 12, the mass of the casing 12 may be minimized, such as by reducing the casing 12 wall thickness. Aluminum, titanium, composites, or other lightweight materials are other possible alternatives for the casing 12.

The casing 12 may have a nose connection 42 for making a connection with the forward end of the airframe 14 or the nose kit 24 (via e.g., the nose ring). The casing 12 may also have an aft connection 44, such as a groove, for connecting with the rearward end of the airframe 14 or the tail adapter 28 (via e.g., the tail ring). A fusewell 46, toward an aft end of the munition 10, houses a fuse 48 that is used for detonating the explosive 40. The fuse 48 may be operatively coupled to the nose kit 24 to receive a signal from the nose kit 24 to detonate the fuse 48. The nose kit 24 may include a sensor, a processor, or other device for sending a signal to the fuse 48 to trigger the firing of the fuse 48 and detonation of the munition 10. The triggering event may be the munition 10 reaching a desired height for detonation (height of burst), for example. In other embodiments, a forward fusewell and fuse may also be provided in the forward end of the casing 12.

The casing 12 also has an electrical connection 50 for electrical communication between the launcher and the munition 10. The electrical connection 50 may be used to provide pre-launch electrical power to components of the munition 10, to provide data (such as targeting data and height-of-burst data) to the munition 10, and/or to provide data from the munition 10 to the launcher (such as data concerning functioning of the munition 10). The electrical connection 50 is coupled within the casing 12 to a pair of conduits 52 and 54. A forward conduit 52 runs forward from the electrical connection 50 toward the nose of the casing 12 and toward the nose kit 24. The aft conduit 52 runs rearward from the electrical connection toward the tail kit 28. The conduits 52 and 54 allow for communication between the launcher and/or various parts of munition 10. For example, using the electrical connection 50 and the conduits 52 and 54, the previously described detonation signal may be sent from the nose kit 24 to trigger the fuse 48 and detonate the explosive 40. Alternatively, at least some of the path for signals may be outside of the casing 12. For example, the wiring 36 (FIG. 2) may travel outside of the casing 12, from the nose kit 24 to the electrical connector 50. An umbilical cable (not shown) may also be connected to the fuse 48 to provide information or other instructions to the munition 10 prior to launch.

In FIG. 3, a partial cutaway view of the munition 10 shows the shell 14 radially outwardly spaced from the casing 12, which forms an annular volume that is continuous from the forward (nose) end of the casing 12 to the opposite rearward (aft) end of the casing 12. The preformed fragments 16 are disposed radially within the annular volume, enclosed by the inner surface of the shell 14 and surrounding the outer surface of the casing 12. The preformed fragments 16 may completely fill the volume to continuously surround the radially outer surface of the casing 12 from the forward end to the aft end via fragment-to-fragment contact with interstitial spaces in-between adjacent fragments 16. Other materials may be included with the fragments 16 and/or may fill the interstitial spaces between fragments 16, as will be described in further detail below.

So as to provide an improved ratio of controlled fragmentation to uncontrolled fragmentation upon detonation of the munition 10, the combined mass of the preformed fragments 16 (i.e., controlled fragmentation) is greater than the combined mass of the casing 12 and the shell 14 (i.e., uncontrolled fragmentation). For example, the ratio of the combined mass of preformed fragments 16 to the combined mass of the casing 12 and the shell 14 may be at least 1.05:1 or greater, more particularly between 1.2:1 to 3:1, and even more particularly between 1.5:1 to 2:1. The upper limit for the combined mass of preformed fragments is typically bounded by structural requirements depending upon the carrier vehicle flight conditions, such as maximum g maneuvers. Such a munition 10 may enhance the dispersal of controlled fragmentation for improving overall fragmentation area coverage and fragmentation pattern density, while limiting travel of fragments beyond the target area.

As discussed above, the amount of uncontrolled fragmentation (caused by fragmenting the walls of the casing 12 and shell 14) may be reduced by minimizing the wall section thicknesses of the casing 12 and the shell 14, or by using lighter weight (e.g., lower density) materials, such as light alloy metals or composites. Simultaneously, the volume and/or mass of material removed from the casing 12 and/or shell 14 may be displaced with the preformed fragments 16 (i.e., controlled fragmentation). By providing a continuous volume between the casing 12 and the shell 14, the amount of preformed fragments 16 may be maximized. More particularly, providing a continuous volume enables the preformed fragments 16 to be effectively distributed around the casing 12 and within the shell/airframe 14. In this manner, the weight and weight distribution (e.g., inertia and center of gravity) of the munition 10 may be configured to emulate the weight and weight distribution of an existing munition for improved PAVEWAY compatibility.

The preformed fragments 16 may include one or more types of fragments. More broadly, the fragments 16 may include fragments with different materials, different shapes, and/or different sizes, although as an alternative all of the fragments may be substantially identical in material, size, and shape. The material for the fragments 16 may be one or more of steel, zirconium-coated steel, tungsten, zirconium-coated tungsten, aluminum, tantalum, lead, titanium, zirconium, copper, molybdenum, magnesium, or other suitable materials. Other materials, such as fillers or spacers, including lethality-enhancement materials, may be included with the fragments 16 and/or disposed between the preformed fragments 16. The fragments 16 may be spheres, balls, cubes, cylinders, flechetts, parallelepipeds, non-uniform shapes (such as used in HEVI-SHOT shotgun pellets), and/or star-shapes having a flat body with edge-shaped protrusions, to give a few non-limiting examples.

The preformed fragments 16 may each be about 0.3 to 450 grams (5 to 7,000 grain weights), for example. More particularly, the preformed fragments 16 may each be about 1.0 gram to about 100 grams (15 to 1,500 grain weights), or may be less than 25 grams (385 grain weights). In some embodiments, the preformed fragments 16 are balls, such as spherical balls, having a diameter between 0.10 inches to 0.5 inches (2.5 mm to 13 mm), more particularly between 0.175 inches and 0.375 inches (4.5 mm to 9.5 mm), or may be greater than 0.25 inches (6.4 mm). There may be one or more size distributions of the preformed fragments 16. For example, a first size distribution may include preformed fragments having a diameter of 0.375 inches (9.5 mm) or less, such as between 0.10 inches and 0.25 inches (2.5 mm and 13 mm); and a second size distribution may include preformed fragments having a diameter greater than 0.375 inches (9.5 mm), such as between 0.25 inches and 0.5 inches (6.3 mm and 12.7 mm). The ratio of the amount of preformed fragments 16 having the first size distribution to the amount of preformed fragments 16 having the second size distribution may greater than 1:1, such as between 4:1 to 20:1. The respective size distributions may be log-normal distributions, and the combination of first and second size distributions may provide an overall bimodal size distribution.

There may be a wide range of the overall number of preformed fragments 16 in the munition 10, with as few as 100 fragments for a small munition to as many as 1,000,000 fragments for a large munition. By way of example, and not limitation, a relatively small munition may have a total weight of about 278 pounds (126 kg), with about 75 pounds (34 kg) of PBXN-110 high-explosive, about 66 pounds (30 kg) of steel or aluminum airframe, about 16 pounds (7 kg) of steel casing, and about 120 pounds (55 kg) of preformed fragments. The total amount of fragmentation (controlled and uncontrolled) in the small munition may be about 63,000 fragments, which may include about 60,000 preformed fragments in the form of tungsten balls having a diameter of about 0.175 inches (4.5 mm), and about 3,000 uncontrolled fragments in the form of aluminum and steel chunks from the casing and shell. In a second non-limiting example, a relatively large munition may have a total weight of about 450 pounds (204 kg), with about 95 pounds (43 kg) of PBXN-110 high-explosive, about 75 pounds (34 kg) of steel casing and aluminum airframe, and about 280 pounds (127 kg) of preformed fragments. The total amount of fragmentation (controlled and uncontrolled) in the large munition may be about 125,000 fragments, which may include about 115,500 preformed fragments in the form of tungsten balls having a diameter of about 0.175 inches (4.5 mm), about 5,500 preformed tungsten balls having a diameter of about 0.375 inches (9.5 mm), and about 4,000 uncontrolled fragments in the form of aluminum and steel chunks from the casing and shell. The total preformed fragment volume in the relatively large 450 pound (204 kg) munition may be about 1750 cubic inches.

In addition to providing enhanced controlled fragmentation, another advantage is that the munition 10 may provide flexibility and adaptability for fragment sizes, weights, and shapes. These parameters are tailorable in accordance with mission requirements. Smaller fragments, for example the size of pebbles, are more suitable for localized full coverage, while larger fragment sizes allow more observable damages within the target site.

The preformed fragments 16 may also include lethality-enhancement material, or the lethality-enhancement material may be provided in the interstitial spaces between the preformed fragments 16. The lethality-enhancement material may alternatively or in addition include energetic materials, such as chemically-reactive materials. The energetic material may be or may include any of a variety of suitable explosives and/or incendiaries, for example hydrocarbon fuels, solid propellants, incendiary propellants, pyrophoric metals (such as zirconium, aluminum, magnesium, or titanium), explosives, oxidizers, or combinations thereof. Detonation of the explosive 36 may be used to trigger reaction (such as detonation) in the energetic material. This adds further energy to the detonation, and may aid in propelling the preformed fragments 16 and/or may aid in fragmenting the casing 12 and/or airframe 14.

Figure 4A:
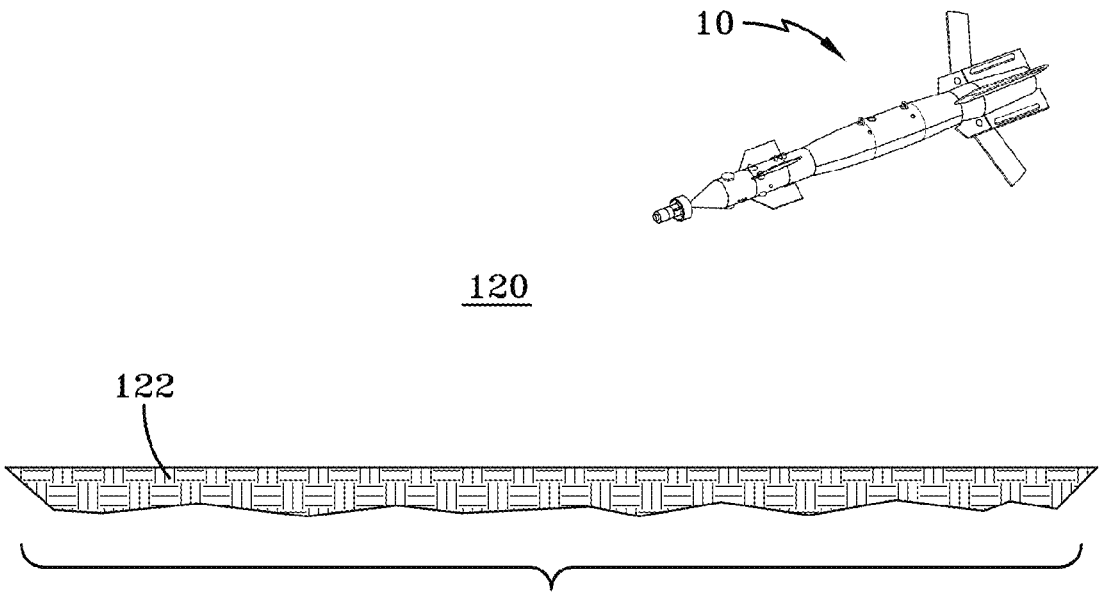
FIG. 4A is a schematic side view illustrating a first step in the use of the munition of FIG. 1 as an area weapon.
Figure 4B:
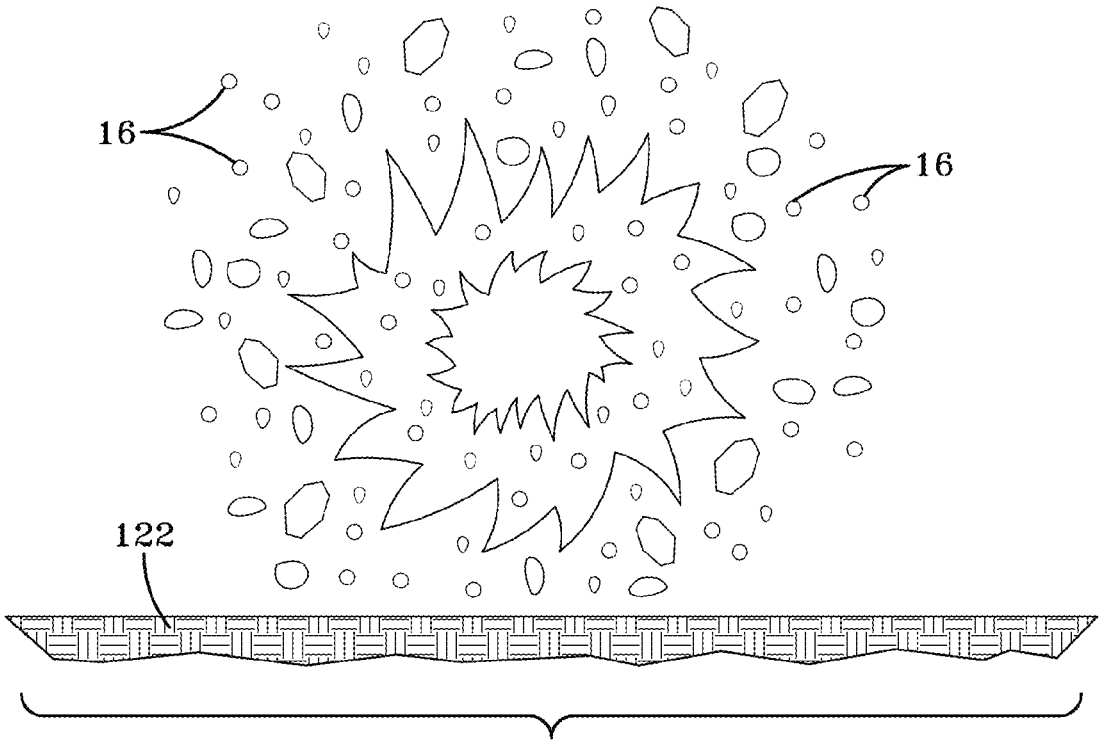
FIG. 4B is a schematic side view illustrating a second step in the use of the munition of FIG. 1 as an area weapon.

FIGS. 4A-4B illustrate use of the munition 10 as a height-of-burst (HOB) area weapon. FIG. 4A shows the munition 10 in a steep dive, approaching a desired detonation location 120 above the ground 122. The munition 10 may be set to detonate the explosive 40 (FIG. 3) at a predetermined height above the ground, to disperse fragments over a large area, for example for use as an antipersonnel weapon. As an example, the desired detonation location 120 may be 3-4 meters above the ground 122, although a wide variety of other detonation heights are possible. The target selection (e.g., the fuse delay and/or the height of bust control setting) may be controlled in any of multiple ways: 1) preset by the ground crew before weapon launch for some systems; 2) controlled from the aircraft or other launcher before weapon launch by the pilot or ground control for some systems; and/or 3) controlled after weapon launch via a data link. For example, the height at which the munition 10 detonates may be set before launch of the munition 10, for example by communication from the launcher (an aircraft 200) to the munition 10 (e.g., the nose kit 24) through the electrical connection 50 (FIG. 3). One or more sensors in the munition 10 may be used to determine the height of the munition 10 above the ground after launch.

FIG. 4B illustrates the detonation of the munition 10 at the location 120. When the desired height is reached, a signal is sent, for instance from the nose kit 34, to trigger the fuse 48 (FIG. 3A) to detonate the explosive 40. This detonation can spread the fragments 16 over a large area. The munition 10 functions with a single detonation, initiated by triggering the fuse 48, in contrast to cluster munitions which have multiple detonations triggered separately at different times and/or in different locations.

Figure 5:
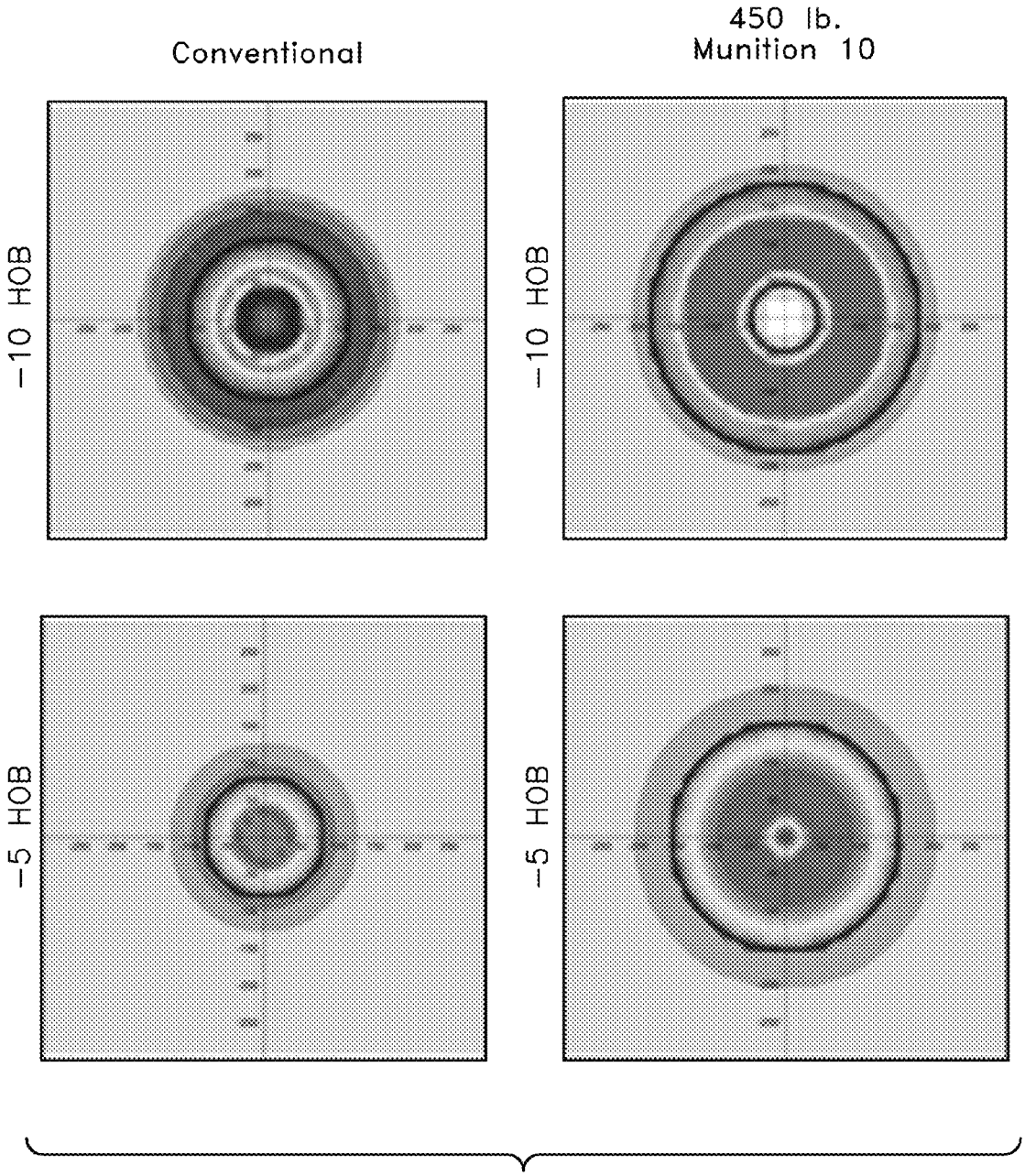
FIG. 5 illustrates lethality maps that simulate the fragmentation pattern of the munition of FIG. 1 compared to the fragmentation pattern of a conventional height-of-burst munition.

Turning to FIG. 5, lethality maps are shown comparing the simulated fragmentation pattern between a conventional HOB munition and the relatively large 450 lb. (204 kg) munition 10 discussed in the second example above. The respective lethality maps show the probability of kill results against a standard target for simulated fragmentation patterns over an area represented by the x-axis and y-axis on each map. The effects of fragmentation pattern and density for both the conventional munition and the exemplary 450 lb. (204 kg) munition 10 are shown at two simulated height-of-burst denotations, namely, 5 meters and 10 meters. The simulated results show that the exemplary 450 lb. (204 kg) munition 10 has a greater fragmentation area and higher probability of kill coverage than the conventional munition at both the 5 meter and 10 meter height-of-burst. The results also show that the exemplary 450 lb. (204 kg) munition 10 has a more concentrated fragmentation density with fewer fragments outside of the target area than the conventional munition.

The enhanced fragmentation effects of the exemplary munition 10 is enabled by the preformed fragments 16 having a known (controlled) size and weight as they are propelled across a distance by the explosive upon detonation, whereas the fragmented walls of the casing 12 and the shell 14 provide fragments of unknown (uncontrolled) size and weight. By providing a greater combined mass of preformed fragments 16 than the combined mass of the casing 12 and the shell 14, the preformed fragments 16 may account for greater than 50%, preferably greater than 60% of the fragments that are sent forth by the munition 10. By maximizing the amount of preformed fragments 16 that continuously fill the volume between the casing 12 and the shell 14, the number of fragments may increase by about 100-200% or more, compared to a conventional munition. The lethal area footprint may be improved by effectively controlling the spreading of the fragments. When the velocity vector of the munition and the velocity vector of the fragments flying outwards from the detonation are added, the fragments have a more downward trajectory (toward the target area) versus an outward trajectory, compared to a general purpose bomb. This results in having a higher fragment spatial density over the desired target area while not spraying a militarily ineffective quantity of fragments over a wide area, thus also limiting collateral damage.

Figures 6A, 6B, 6C:
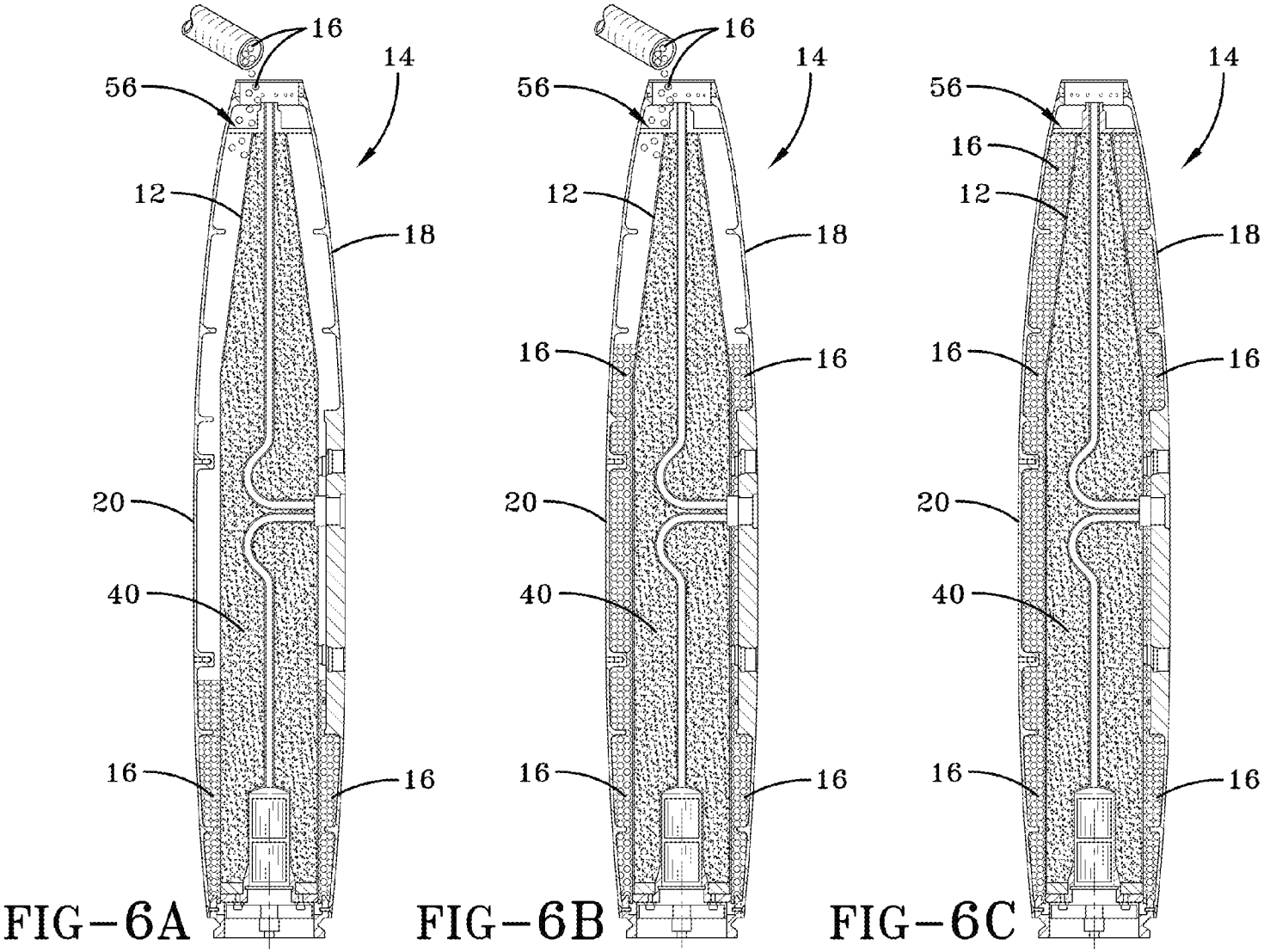
FIGS. 6A-6C illustrates a method for disposing preformed fragments in an annular volume of the munition of FIG. 1.

Turning to FIGS. 6A-6C, an exemplary method for assembling the munition 10 is shown. First, an explosive 40 is encased in a casing or canister 12, such as by casting the explosive 40 in the canister 12. Next, the canister 12 is enclosed within the shell 14, such as by enclosing the upper clamshell half 18 and lower clamshell half 20 around the casing 12, and forming an empty continuous annular volume therebetween. The preformed fragments 16 may be individual metal pellets that are loose, not attached, free-flowing and capable of being poured into the volume between the casing 12 and the shell 14. The fragments 16 may be a uniform mixture or an admixture randomly distributed within the volume. After enclosing the casing 12 with the shell 14, the fragments 16 are poured into the volume through an opening 56 toward the forward end, as shown in FIGS. 6A-6B. As shown in FIG. 6C, the preformed fragments 16 may completely fill the volume so as to provide a continuous cylindrical fragment 16 layer that surrounds the canister 12 and extends from the forward end of the canister 12 to the opposite aft end. The opening 56 in the forward end may be sealed with an epoxy or other sealant to enclose and secure the fragments 16 within the volume. By providing a continuous volume that is fillable with the preformed fragments 16 in the manner described above, the amount and distribution of fragments 16 may be enhanced, and the assembly of the munition 10 may be improved due, at least in part, to limiting the spacing and tolerance requirements that may otherwise be required if packs or blocks of fragments were mounted between the casing 12 and the shell 14.

Depending on the size, size distribution, shape, quantity, etc. of the preformed fragments 16, the packing density of the fragments 16 in the volume may be increased by also adding filler materials between the fragments 16. For example, the filler materials may include polymeric materials, such a polypropylene spheres, or lethality enhancement materials, as discussed above. The filler materials may be appropriately sized to fill the interstitial spaces between the preformed fragments 16, for example, sized about equal to or smaller than the median size of the interstices with a log-normal size distribution. To determine the amount of filler material to be added with the fragments 16 into the volume, one method includes completely filling the volume with the fragments 16 (as shown in FIG. 6C) and determining a fragmentation fill volume. The difference in the fragmentation fill volume and the annular volume between the canister 12 and the shell housing 14 is used to calculate a void volume. Thereafter, the preformed fragments 16 are emptied from the volume and admixed with the filler material in an amount about equal to or less than the calculated void volume. After the fragments 16 and fillers are admixed, the combined admixture is poured into the volume through the opening 56 in the forward end, and the opening 56 is then sealed.

Figures 7A, 7B, 7C:
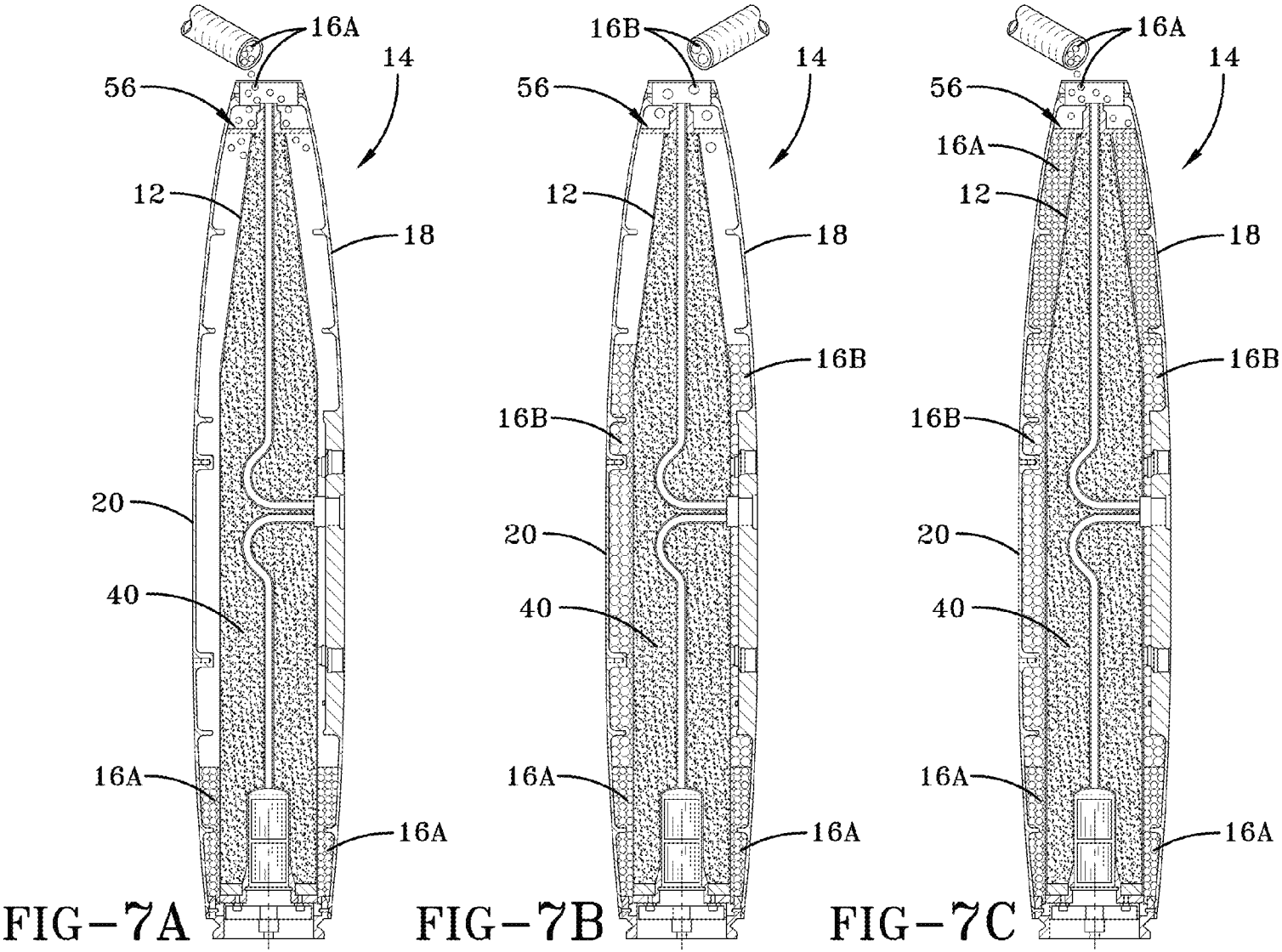
FIGS. 7A-7C illustrates another method for disposing preformed fragments in a volume of the munition of FIG. 1.

The fragments 16 may also be categorized by one or more of material, size, size distribution, density, and/or shape, and then layered within the volume according to category. For example, as shown in FIGS. 7A-7C, the respective categories of preformed fragments 16A and 16B, for example, may be arranged within the volume in layers as annular rings surrounding the radially outer surface of the casing 12. This method may be advantageous for configuring the fragments 16A and 16B within the volume to shift the center or gravity and/or for emulating the combined overall mass of an existing munition for e.g., improved PAVEWAY compatibility.

The configurations and methods shown in FIGS. 2-7C are only a few examples of possible configurations of the munition 10. Many alternative configurations and materials are possible, some of which are described below.

Figure 8:
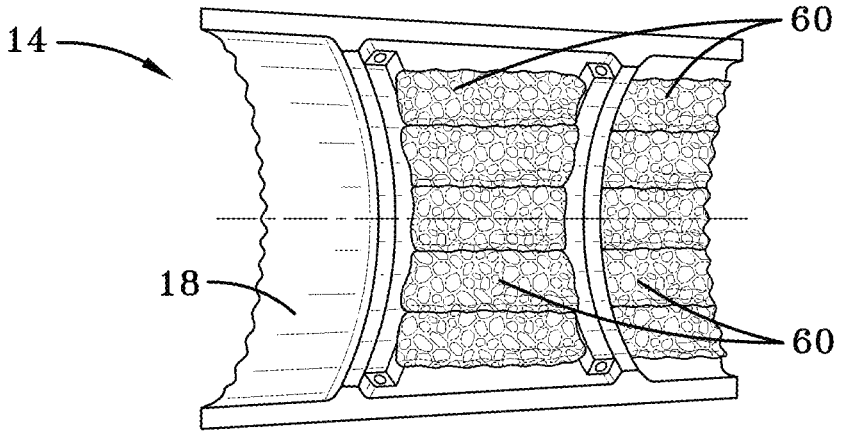
FIG. 8 illustrates an oblique view of a method for placing fragmentation packs in part of a clamshell piece that is part of the munition of FIG. 1.

Turning to FIGS. 8-12, alternative processes of filling the volume between the casing 12 and shell 14 are shown. In FIG. 8, bags or packs 60 containing preformed fragments are placed in the volume between the casing 12 and the shell 14, such as on the inside surface of one or more of the clamshell pieces 18 and 20, for example, in bays within the clamshell pieces. The fragmentation packs 60 may be enclosed packages containing fragments and possibly other lethality enhancement materials. The fragments enclosed in the packs 60 may be similar in material and other aspects to the various fragments 16 described above. Additional material in the fragmentation packs 60 may include any of the other lethality-enhancement materials described above, such as energetic material. The fragmentation pack casing for the fragmentation packs 60 may include any of a variety of suitable material, such as suitable metal and/or plastic materials. The fragmentation packs 60 may be deformable to aid in placement of the fragmentation packs 60 in the shell halves 18, 20. The fragmentation packs 60 may all be substantially identical, or there may be different sizes and/or shapes for the fragmentation packs 60 to be placed in different areas that constitute the annular volume.

Figure 9:
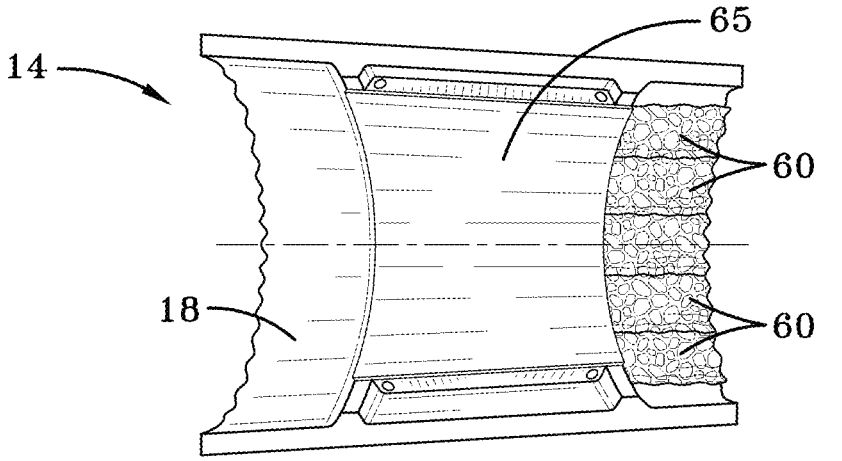
FIG. 9 illustrates an oblique view of a method for securing the fragmentation packs of FIG. 8 to the clamshell piece.

In FIG. 9, the clamshell piece 18 and/or 20 is sealed to keep the fragments and the packs (bags) in place. The clamshell may be sealed by a solid material 65, such as a sheet of aluminum. The solid-material 65 shell may be bonded to the clamshell piece and/or the packs with polysulfide (or another suitable adhesive), and then mechanically fastened to keep it in place, such as with a series of screws or bolts.

Figure 10:
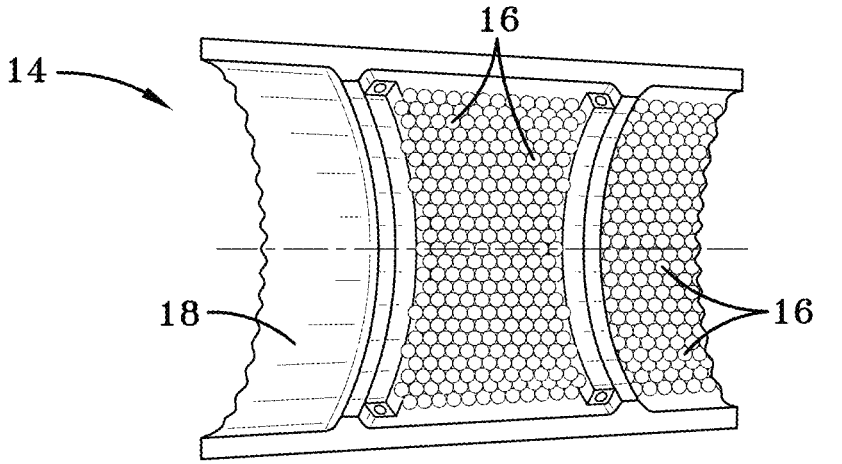
FIG. 10 illustrates an oblique view of a method for bonding preformed fragments to an inside surface of a clamshell piece that is part of the munition of FIG. 1.

In FIG. 10, preformed fragments 16 are bonded to the inside surface of one or more of the clamshell pieces. The fragments may be spherical fragments, such as reactive material coated metal alloy balls, and may be bonded to the clamshell piece using polysulfide or a polysulfide compound.

Figure 11:
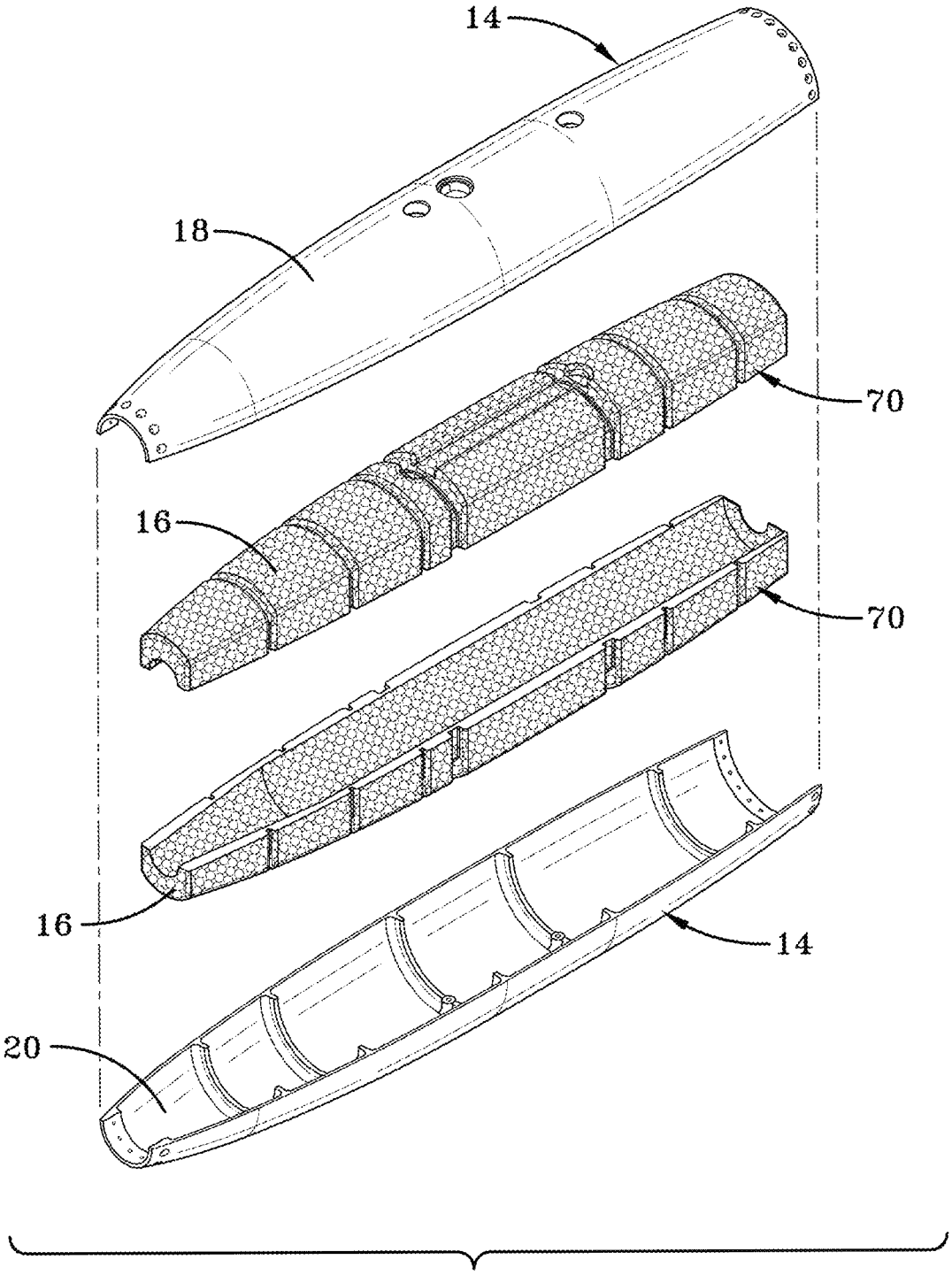
FIG. 11 illustrates an oblique view of a fragment block that may be used in an embodiment of the munition of FIG. 1.

FIG. 11 shows a cast fragment block 70 that is placed in one or more of the clamshell pieces 18, 20. The block 70 may be cast into a shape that fits one or more of the clamshell pieces 18, 20. For example, the fragment block 70 may be cast to fit into several bay portions of the shell 14. A mold may be made corresponding to the shape of the shell 14 portion to be filled, with different portions possibly having different molds (with different shapes). The mold may then be filled with a mixture that includes one or more the various types of fragments described elsewhere herein. The mixture may include the fragments (for example two sizes of steel shot, heavy shot, and tungsten alloy fragments, more broadly fragments of multiple sizes, shapes, and/or materials), with a binder material. Examples of suitable binder materials include EPOCAST (a pourable epoxy resin material) and CLEAR FLEX (a urethane-based material). Epoxy-based binders, or energetic binder materials, such as aluminum-polytetrafluoroethylene (PTFE, such as sold under the trademark TEFLON) based materials are some other examples. Other materials, such as incendiary or pyrophoric materials, may also be included in the mixture. One desirable characteristic of the binder material is that it not unduly inhibit separation or singulation of the fragments when the explosive within the munition is detonated.

Figure 12:
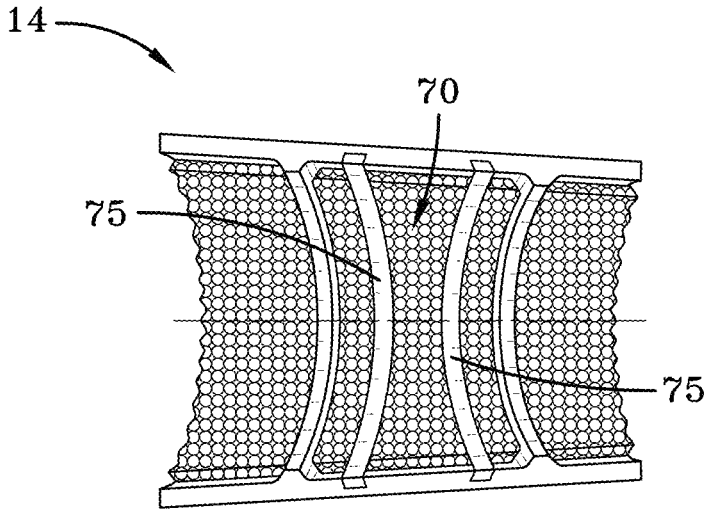
FIG. 12 is an oblique view showing one possible way of securing the fragment block of FIG. 11 to a clamshell piece that is part of the munition of FIG. 1.

After the fragment block 70 is removed from the mold, the block 70 may then be placed in an appropriate shell 14 portion, such as in one more bay portions. The block 70 may be adhesively secured in the bay portion 70 with a suitable adhesive. Alternatively or in addition, the block 70 may be at least in part mechanically secured in the shell 14 portion, for example being secured by straps 75, as shown in FIG. 12. Other sorts of mechanical securement may be used instead or in addition to such straps, for instance, a sheet metal plate across the block 70 to hold the block 70 in the shell 14 portion. The composition of the cast fragment blocks, such as the cast fragment block 70, may be varied to achieve different effects. Different types of fragments or amounts of fragments may be used to achieve different weights. In addition, differences in sizes and/or types of fragments may produce different fragmentation effects.

The munition 10 provides many advantages over prior munitions that are also capable of height-of-burst area neutralization. These advantages may include increased controlled fragmentation, better focusing of fragments where desired, improved fragmentation area coverage, less collateral damage, improved assembly of the munition, incorporation of other lethality-enhancement materials for different effects, among other benefits.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A munition comprising:

a casing;

an explosive enclosed by the casing;

a shell surrounding the casing; and preformed fragments in a volume between the casing and the shell;

wherein the preformed fragments have a combined mass greater than the combined mass of the casing and the shell; and wherein a ratio of the combined mass of the preformed fragments to the combined mass of the casing and the shell is in a range between 1.05:1 to 3.7:1.

2. The munition according to claim 1, wherein the preformed fragments fill the volume between the casing and the shell and continuously surround the radially outer surface of the casing from one end of the casing to the opposite end of the casing.

3. The munition according to claim 1, wherein the preformed fragments include free flowing metal pellets.

4. The munition according to claim 1, wherein the preformed fragments include balls having a diameter between 0.10 inches to 0.50 inches.

5. A munition comprising:

a casing;

an explosive enclosed by the casing;

a shell surrounding the casing; and preformed fragments in a volume between the casing and the shell;

wherein the preformed fragments have a combined mass greater than the combined mass of the casing and the shell;

wherein the preformed fragments include balls having a first size distribution between 0.10 inches to 0.25 inches in diameter, and a second size distribution between 0.25 inches to 0.50 inches in diameter; and wherein a ratio of the amount of preformed fragments having the first size distribution to the amount of preformed fragments having the second size distribution is between 1:1 to 20:1.

6. The munition according to claim 1, wherein the preformed fragments are enclosed as parts of self-contained fragmentation packs that are located in the volume between the casing and the shell.

7. The munition according to claim 1, wherein the preformed fragments are in cast fragment blocks that include multiple of the preformed fragments held together by a binder.

8. The munition according to claim 1, wherein the preformed fragments are made of metal selected from the group consisting of: steel, tungsten, aluminum, tantalum, lead, titanium, zirconium, copper, molybdenum, magnesium, zirconium-coated steel, zirconium-coated tungsten, and other similar materials.

9. The munition according to claim 1, wherein the volume between the casing and the shell includes interstitial spaces between the preformed fragments, and wherein the interstitial spaces contain a filler material.

10. The munition according to claim 9, wherein the filler material is a polymer.

11. The munition according to claim 9, wherein the filler material is a metallic powder.

12. The munition according to claim 1, wherein the shell is an airframe having a forward connection configured for mounting a nose kit, and an aft connection configured for mounting a tail kit.

13. The munition according to claim 12, wherein the airframe is configured to emulate the aerodynamic properties of an existing munition airframe.

14. The munition according to claim 1, wherein the casing is a unitary welded casing made of steel or aluminum, and wherein the shell is made of aluminum, steel, and/or composites.

15. The munition according to claim 1, wherein the preformed fragments are disposed in the volume to enable emulation of the center of gravity characteristics of an existing munition.

16. The munition according to claim 1, wherein the ratio of the combined mass of the preformed fragments to the combined mass of the casing and the shell is in a range between 1.2:1 to 3:1.

* * * * *